US008440052B2

(12) United States Patent
Duggirala et al.

(10) Patent No.: US 8,440,052 B2
(45) **Date of Patent: *May 14, 2013**

(54) METHOD AND ARRANGEMENT FOR FEEDING CHEMICALS INTO A PULP PROCESS STREAM

(75) Inventors: Prasad Duggirala, Naperville, IL (US); Michael Murcia, DeKalb, IL (US); Tommy Jacobson, Helsinki (FI); Mika Salonen, Espoo (FI); Martti O. Latva, Rusko (FI)

(73) Assignee: Nalco Company, Naperville, IL (US)

( * ) Notice: Subject to any disclaimer, the term of this patent is extended or adjusted under 35 U.S.C. 154(b) by 388 days.

This patent is subject to a terminal disclaimer.

(21) Appl. No.: 12/474,990

(22) Filed: May 29, 2009
(Under 37 CFR 1.47)

(65) Prior Publication Data

US 2010/0300632 A1 Dec. 2, 2010
US 2013/0020041 A9 Jan. 24, 2013

Related U.S. Application Data

(63) Continuation-in-part of application No. 11/339,169, filed on Jan. 25, 2006, now Pat. No. 7,550,060.

(51) Int. Cl.
*D21C 3/22* (2006.01)

(52) U.S. Cl.
USPC ..... 162/70; 162/100; 162/183; 366/167.1; 366/341; 137/602; 137/896

(58) Field of Classification Search ..... 162/4–9, 162/17, 70, 100, 189, 190, 183, 264, 322, 162/381; 366/167.1, 163.2, 341; 137/602, 137/888, 890, 896
See application file for complete search history.

(56) References Cited

U.S. PATENT DOCUMENTS

| | | | | |
|---|---|---|---|---|
| 6,200,417 | B1 * | 3/2001 | Binder et al. | 162/57 |
| 6,986,832 | B2 * | 1/2006 | Lamminen et al. | 162/381 |
| 7,550,060 | B2 * | 6/2009 | Jacobson et al. | 162/158 |
| 7,785,442 | B2 * | 8/2010 | Jacobson et al. | 162/158 |
| 7,981,251 | B2 * | 7/2011 | Jacobson et al. | 162/232 |
| 2002/0131325 | A1 * | 9/2002 | Matula | 366/165.1 |
| 2007/0169908 | A1 * | 7/2007 | Jacobson et al. | 162/209 |
| 2009/0139676 | A1 | 6/2009 | Todorovic et al. | |
| 2009/0211721 | A1 | 8/2009 | Jacobson et al. | |

OTHER PUBLICATIONS

Smook, Handbook for Pulp and Paper Technologists, 1992, Angus Wilde Publications, 2nd edition, chapters 14 and 15.*

* cited by examiner

*Primary Examiner* — Anthony Calandra
(74) *Attorney, Agent, or Firm* — Benjamin E. Carlsen; Andrew D. Sorenson

(57) ABSTRACT

An apparatus for feeding one or more chemicals into a process stream of a pulp process is disclosed, as well as a method of utilizing the apparatus for feeding one or more chemicals into a pulp process is disclosed.

1 Claim, 6 Drawing Sheets

Pulping and Bleaching

METHOD AND ARRANGEMENT FOR FEEDING CHEMICALS INTO A PULP PROCESS STREAM

CROSS-REFERENCE TO RELATED APPLICATIONS

This application is a continuation in part of application Ser. No. 11/339,169 filed on Jan. 25, 2006 and which issued as U.S. Pat. No. 7,550,060 on Jun. 23, 2009.

STATEMENT REGARDING FEDERALLY SPONSORED RESEARCH OR DEVELOPMENT

Not Applicable.

FIELD OF THE INVENTION

This disclosure relates to a method and apparatus for feeding chemicals into a pulp process stream of a papermaking process.

BACKGROUND

Various types and amounts of chemicals are added to a pulp mill process. In particular, chemicals are added into a process stream of a pulp mill process. The optimal feeding of these chemicals is both a quality and a cost issue in that the optimal feeding of chemicals into a process stream results in the following: a) better runnability of the paper machine; b) the quality of the end product is more predictable and uniform; c) less web breaks and down-time of the paper machine; d) a reduction in the quantity of the chemical that needs to feed into a papermaking machine; e) smaller consumption of fresh water; and f) less energy is needed to heat fresh water.

Optimal feeding of chemicals into a process stream occurs when there is rapid mixing of chemical into the process stream, presence of locally stoichiometric conditions, minimized water usage in the feeding arrangement, and optimal residence/contact times of chemicals. More specifically, having locally stoichiometric conditions means having the optimal ratio of chemicals in the process stream for the chemicals to react, and optimal residence time of the chemicals means that the chemicals should be fed into the process stream so that all the chemicals that have been fed into the system have had enough time to take effect but not too long to maintain the desired effect.

Many prior art methods for feeding chemicals into a pulp process stream of a pulp mill process do not result in the optimal feeding of chemicals into the pulp process stream. Therefore, a need for an apparatus and method that can optimally feed one or more chemicals into a pulp process stream exists in the papermaking industry.

SUMMARY OF THE INVENTION

The present invention provides for a method for feeding one or more chemicals into a process stream of a pulp process comprising: (a) providing one or more mixing apparatuses comprising a first conduit having one or more inlets and outlets; a second conduit having one or more inlets and outlets, wherein said first conduit secures to said second conduit and traverses said second conduit; a mixing chamber that has one or more inlets and outlets, wherein said second conduit secures to said mixing chamber and wherein said outlets of said first conduit and said outlets of said second conduit are in communication with said mixing chamber; and an adaptor that is in communication with said outlet of said mixing chamber and is secured to said mixing chamber; (b) mounting said apparatuses containing an adaptor over an opening in a pulp process; (c) running said pulp process so that said process stream flows through said pulp process; (d) introducing one or more chemicals and a feeding liquid into said mixing chamber of said apparatuses by introducing said chemicals or said feeding liquid into said inlets of said first conduit and said second conduit of said apparatuses; (e) mixing said chemicals and said feeding liquid in said mixing chamber of said apparatuses to form a mixture of said chemicals and said feeding liquid; and (f) dispensing said mixture into said process stream of said pulp process through said adaptor of said apparatuses that is in communication with said process stream.

The present invention also provides for a method for feeding one or more chemicals into a process stream of a process: (a) providing one or more mixing apparatuses comprising a first conduit having one or more inlets and outlets; a second conduit having one or more inlets and outlets, wherein said first conduit secures to said second conduit and traverses said second conduit; a mixing chamber that has one or more inlets and outlets, wherein said second conduit secures to said mixing chamber and wherein said outlets of said first conduit and said outlets of said second conduit are in communication with said mixing chamber; and an adaptor that is in communication with said outlet of said mixing chamber and is secured to said mixing chamber; (b) mounting said apparatuses containing an adaptor over an opening in said process stream; (c) running said process stream of said process; (d) introducing one or more chemicals into said mixing apparatuses by introducing said chemicals into said apparatuses to form a mixture containing said chemicals; and (e) dispensing said mixture into said process stream.

DETAILED DESCRIPTION OF THE INVENTION

Figure 8:
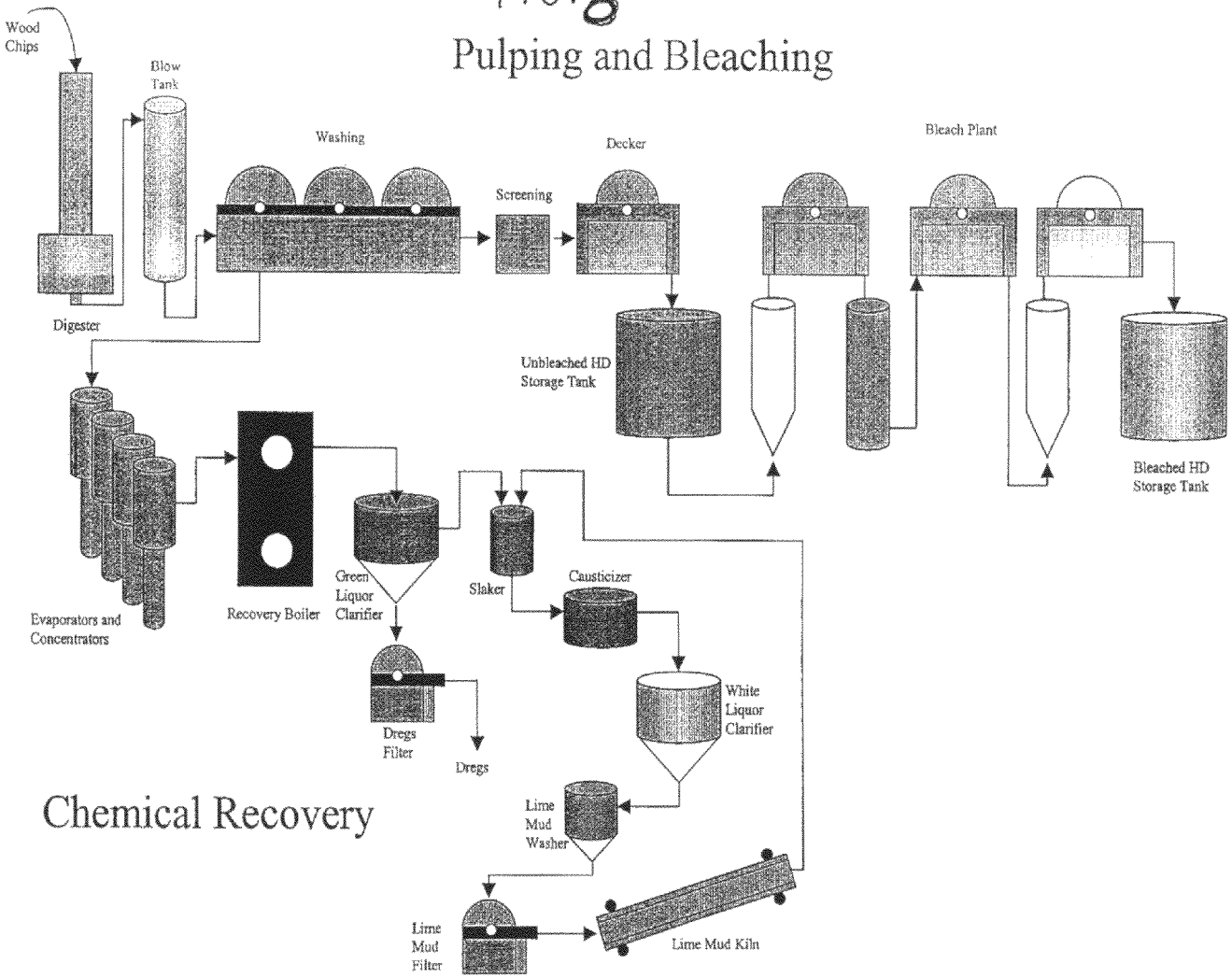
FIG. 8 is a schematic of the pulping and bleaching process used in preparation for making a paper product, e.g. tissue, board, sheet, pulp product.
Figure 9:
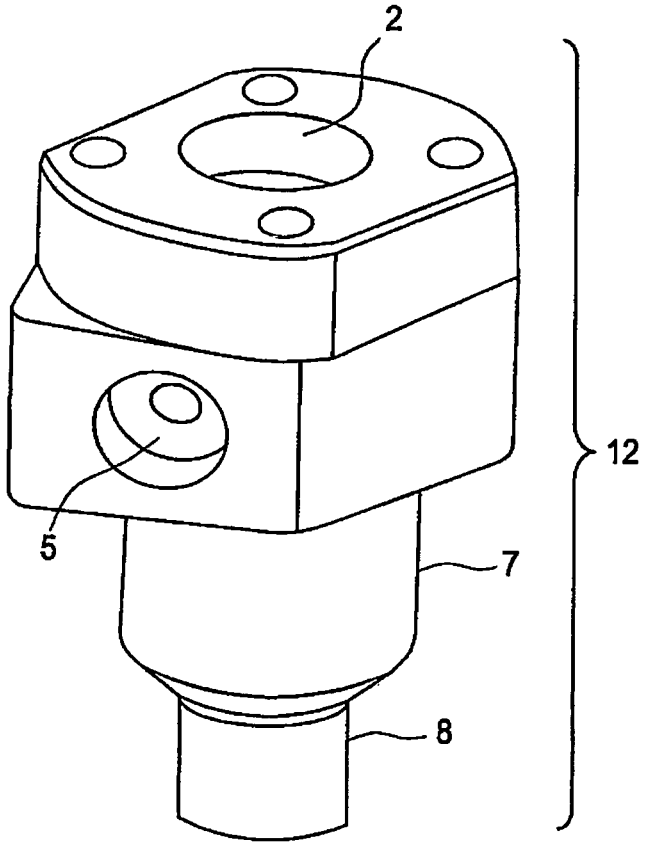
FIG. 9 is a side elevation view of an apparatus according to one embodiment of the present invention.

"Pulp process" means a process that occurs in a pulp mill operation and/or bleaching operation, including, but not limited to one or more of the various stages outlined in FIG. 8. Pulping and bleaching operations fall within the general purview of papermaking process, e.g. a papermaker can be a person who operates a pulping mill.

The apparatus of the present invention is essentially a reactor where chemical reactions can either: a) happen to activate the chemicals added to the apparatus expeditiously under controlled conditions, orb) the chemicals can be prevented from mixing with each other or other species by selecting appropriate mixing times versus chemical kinetics and shear levels. For example, the reaction rate of the chemicals that are being added to the process stream can be slowed down or even prevented by ensuring much slower chemical kinetics than the residence times inside the device.

The number identifiers referenced throughout the DETAILED DESCRIPTION OF THE INVENTION are noted on one or more of FIGS. 1-9; the number identifiers are consistent throughout all figures and therefore when reading the DETAILED DESCRIPTION OF THE INVENTION, please reference one or more of the nine figures.

As stated above, the apparatus utilized for the present invention includes four primary components: a first conduit (1); a second conduit (4); a mixing chamber (7); and optionally an adaptor (8). The dimensions and geometries of each element of the apparatus depends upon how much chemical needs to be added to the pulp mill process, as well other factors, such as the construction of the pulp process stream conduit that transfers fluid from one point to another (9). The apparatus of the present invention may be made of any suitable material for handling various types of papermaking chemicals, for example, stainless steel.

The first conduit (1) has one or more inlets (2) and outlets (3). Preferably, the conduit has both a head portion (10) and a portion (11) that is conical in shape.

The second conduit (4) has one or more inlets (5) and outlets (6). The second conduit (4) secures to the first conduit's head portion (10) by any fastening means that would be appreciated by one of ordinary skill in the art, for example, the head portion (10) of the first conduit and the second conduit (4) may have one or more openings so that a screw can secure one conduit to another.

The mixing chamber (7) has one or more inlets (17) and outlets (18) that are in communication with the outlets of both the first conduit (1) and the second conduit (4). The mixing chamber (7) secures to the second conduit (4). The mixing chamber (7) may secure to the second conduit (4) by any fastening means that would be appreciated by one of ordinary skill in the art, for example, both the second conduit (4) and the mixing chamber (7) may have one or more openings so that a screw can secure the second conduit to the mixing chamber, or the outer surface of the mixing chamber (7) can fuse to the outer surface of the second conduit (4).

The adaptor (8) secures to the mixing chamber (7) and is communication with the outlets of the mixing chamber (7). The adaptor (8) may secure to the mixing chamber (7) by any fastening means that would be appreciated by one of ordinary skill in the art, for example, a portion of the mixing chamber (7) may insert into the adaptor (8).

In another embodiment, the inlets (5) of said second conduit (4) are perpendicular to said outlets of said second conduit (4).

In another embodiment, the first conduit (1) traverses said second conduit (4) perpendicular to the inlets (5) of said second conduit (4).

In another embodiment, the first conduit (1) has a head portion (10) that does not traverse said second conduit (4) and a portion that traverses said second conduit (4), wherein the portion (11) that traverses said second conduit (4) is conical in shape and wherein the point of said first conduit (1) is in communication with said mixing chamber (7).

As stated above, the present invention provides for a method of feeding one or more chemicals into a pulp process stream.

In one embodiment, the (12) adaptor (8), alone or as part of the apparatuses for feeding, is mounted over an opening (16) in the pulp process stream conduit (9) and the adaptor (8) is secured to the pulp process stream conduit (9) by any means that would be appreciated by one of ordinary skill in the art. The feeding apparatus of the present invention, if not already done so, is connected with the adaptor. After this setup is established, one or more chemicals and a feeding liquid are introduced into the apparatus (12), mixed in the mixing chamber (7), and fed into the pulp process stream conduit (9).

In another embodiment, the co-feeding of different chemicals into a pulp process stream (13) can be achieved by the following steps: introducing several different chemicals into the apparatus (12), allowing a mixture of the different chemicals to form, and dispensing the mixture into the pulp process stream (13); or by aligning a series of apparatuses (12) and dispensing chemicals. Chemicals may be added to the system in any order prescribed by a person of ordinary skill in the art. For example, chemicals maybe added sequentially, simultaneously or in pre-programmed order.

In another embodiment, the mixing is a staged mixing—mixing of chemicals prior to their introduction into the pulp process stream. Staged mixing lasts for a time period that comports with the desired reaction rate of the chemicals fed into the mixing apparatus. In yet a further embodiment, the staged mixing lasts from about 5 microseconds to about 500 milliseconds.

In another embodiment, the activity of said chemicals is controlled by adjusting the flow rate of said chemicals and said feeding liquid, which are introduced into said apparatuses. One or more pumps that are in communication with said apparatuses may adjust the flow rate of the chemicals and the feeding liquid that are being introduced into the apparatus of the present invention. Staged mixing can be achieved in the mixing chamber by controlling flow rates of the chemicals and the feeding liquid into the mixing chamber.

In another embodiment, the activity of said chemicals, prior to their introduction into said process stream, is controlled by adjusting the flow rate of said chemicals and said feeding liquid, which are introduced into said mixing chamber.

In another embodiment, the chemicals are selected from the group consisting of: sticky and/or pitch control products; surfactants; polymers; drainage aids; defoamers; bleaching aids; and a combination thereof. Various chemical treatment programs employing one or more chemicals may be developed by one of ordinary skill in the art and employed by the apparatuses (12) of the claimed invention.

In another embodiment, the feeding liquid is selected from the group consisting of fresh water; clear filtrate; whitewater, thin stock; and a combination thereof.

In another embodiment, the chemicals are diluted with a dilution liquid prior to their introduction in said first conduit (1) or said second conduit (4). In yet a further embodiment, the dilution liquid contains water.

In another embodiment, the process stream (13) contains a furnish of a papermaking process.

In another embodiment, the dispensing said mixture occurs in at least one or more of the following locations of said pulp process: digestion; repulping; disintegration; washing; oxygen delignification; chemical recovery; clarifiers; bleaching; disperging; and deinking.

In another embodiment, the pulp process contains at least one of the following pulps: virgin pulp; recycled pulp; chemical pulp; mechanical pulp; and chemical-mechanical pulp.

In another embodiment, the chemicals contain a surfactant or a polymer and said feeding liquid is optionally white water, and wherein said mixture is dispensed before a digester of said pulp process.

In another embodiment, the chemicals contain a drainage aids or defoamers and said feeding liquid is optionally white water and/or clear water, and wherein said mixture is added in the washing stage of said pulp process.

In another embodiment, the chemicals contain defoamers and said feeding liquid is optionally white water and/or clear water, and wherein said mixture is added in the oxygen delignification stage of said pulp process.

In another embodiment, the chemicals are polymers and said feeding liquid is optionally white water and/or clear water, and wherein said mixture is further clarified.

In another embodiment, the chemicals are bleaching aids and said feeding liquid is optionally white water and/or clear water, and wherein said mixture is added in the bleaching stage of said pulp process.

In another embodiment, the chemicals are polymers or surfactants for ink separation and said feeding liquid is optionally white water and/or clear water, and wherein said mixture is added to said pulp process prior to the flotation cell to improve ink separation.

In another embodiment, the chemicals are stickes and tackies control products and said feeding liquid is optionally white water and/or clear water, and wherein said mixture is added to a recycle pulp process.

Figure 1:
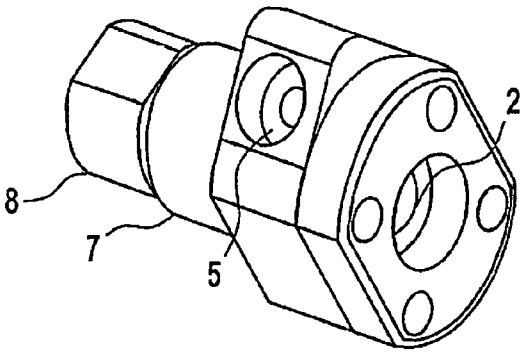
FIG. 1 is a side elevation view of an apparatus according to one embodiment of the present invention.
Figure 2:
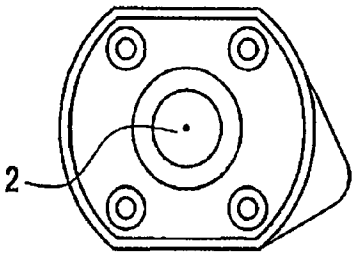
FIG. 2 is a cross-sectional view of the apparatus of FIG. 1.
Figure 3:
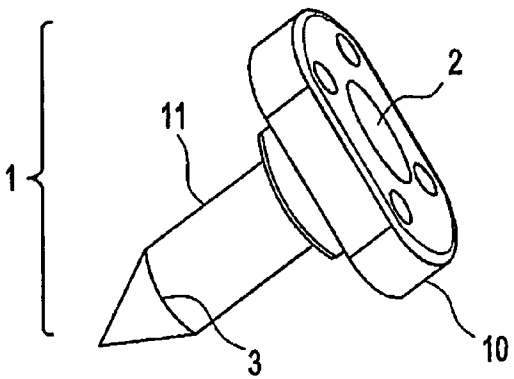
FIG. 3 is a side elevation view of the first conduit of the apparatus of FIG. 1.
Figure 4:
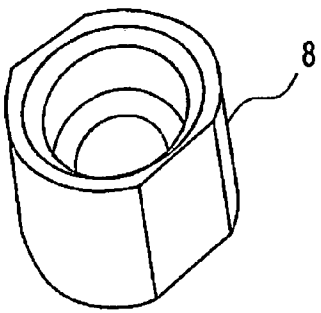
FIG. 4 is a side elevation view of the adaptor of the apparatus of FIG. 1.
Figure 5:
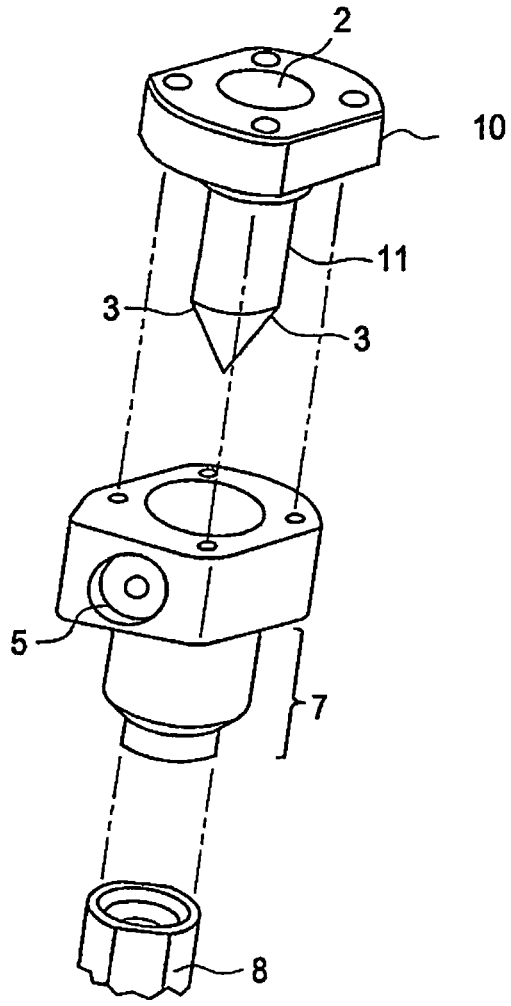
FIG. 5 is an exploded side elevation view of the first conduit, second conduit, mixing chamber and adaptor of one embodiment of the present invention.
Figure 6:
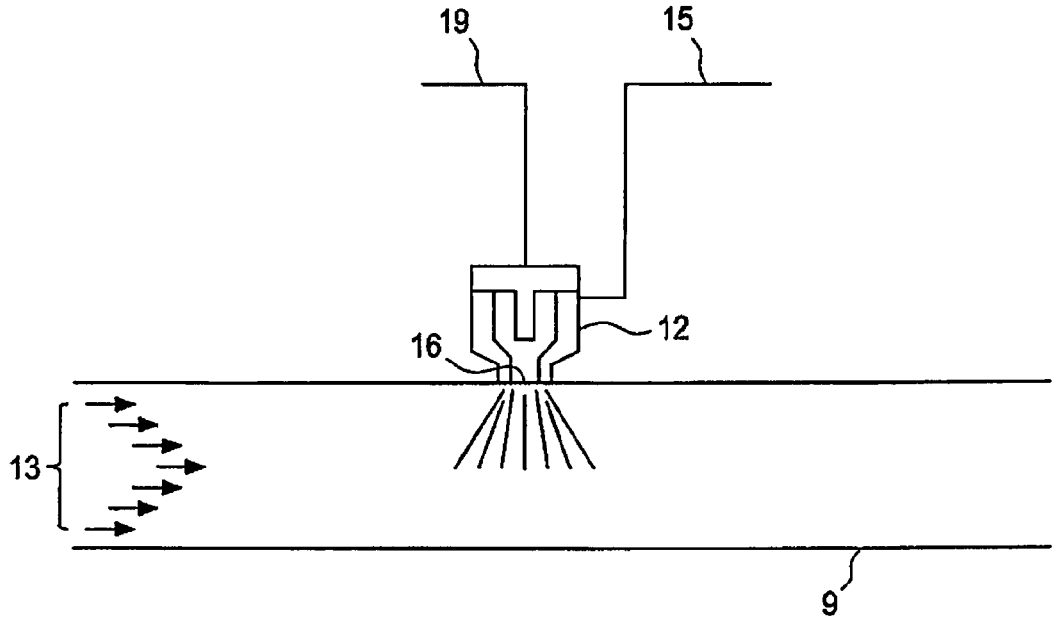
FIG. 6 represents a schematic illustration a method of feeding chemical into a pulp process stream in accord with one embodiment of the present invention.
Figure 7:
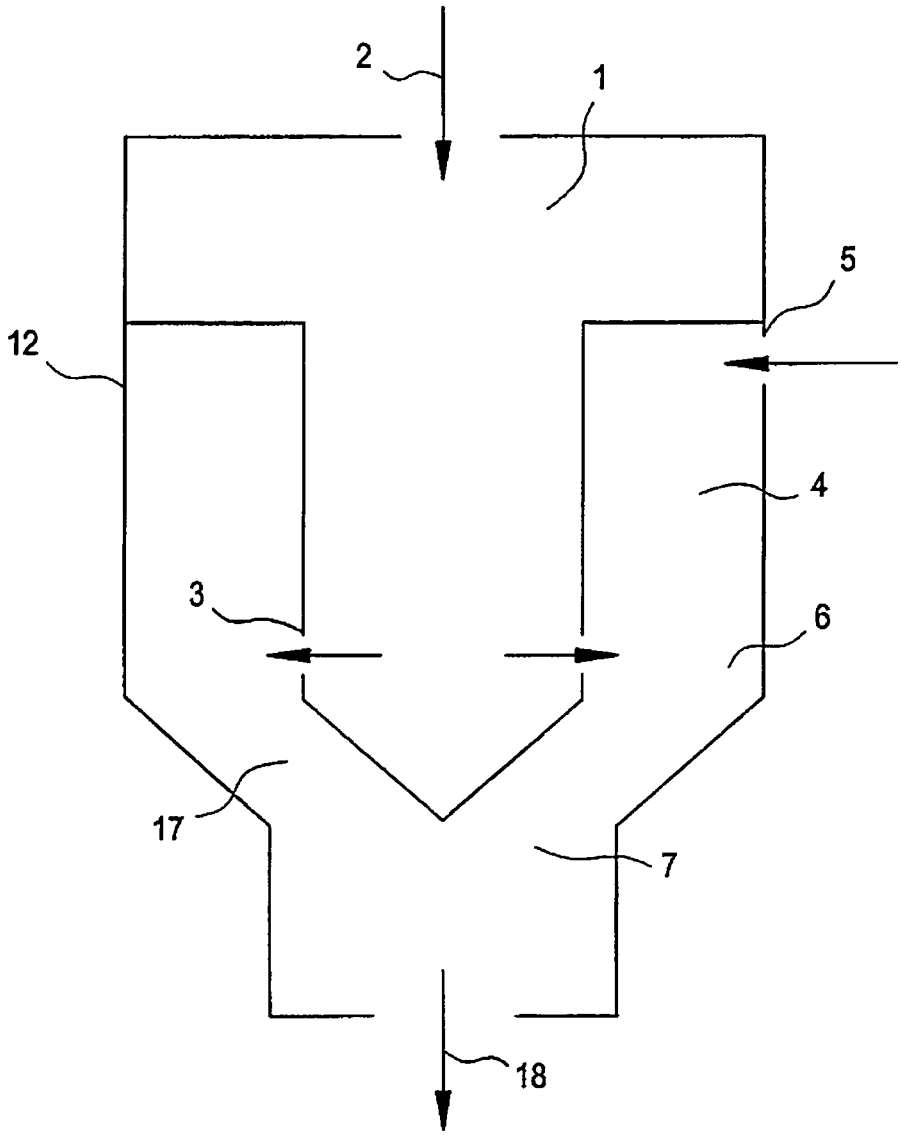
FIG. 7 represents a schematic illustration of an apparatus of the present invention.

Referring to both FIGS. 6 and 7, in one embodiment, chemicals (19) are introduced into the inlet (2) of a first conduit (1). Subsequently, the chemicals flow through the conduit and out said outlets (3) of the first conduit (1) and into the inlets (17) of the mixing chamber (7). A feeding liquid (15) is also introduced into a second conduit (4). The liquid in the second conduit (4) swirls or vortexes around the first conduit (1), and exits out the outlets (6) of the second conduit and into the mixing chamber (7) via the inlets (17) of the mixing chamber (7). The two fluids from the first conduit (1) and the second conduit (4) mix in the mixing chamber (7) and then the mixture flows through the mixing chamber (7) outlet (18), which in turn flows through the adaptor (8) that is mounted to an opening (16) in the pulp process stream (13) and this liquid flows into the pulp process stream (13).

We claim:

1. A method for feeding one or more chemicals into a process stream of a pulp process comprising: a. providing one or more mixing apparatuses comprising a first conduit having one or more inlets and outlets; a second conduit having one or more inlets and outlets, wherein said first conduit secures to said second conduit and traverses said second conduit; a mixing chamber that has one or more inlets and outlets, wherein said second conduit secures to said mixing chamber and wherein said outlets of said first conduit and said outlets of said second conduit arc in communication with said mixing chamber; and an adaptor that is in communication with said outlet of said mixing chamber and is secured to said mixing chamber; b. mounting said apparatuses containing an adaptor over an opening in a pulp process; c. running said process so that said process stream flows through said process; d. introducing one or more chemicals and a feeding liquid into said mixing chamber of said apparatuses by introducing said chemicals or said feeding liquid into said inlets of said first conduit and said second conduit of said apparatuses; e. mixing said chemicals and said feeding liquid in said mixing chamber of said apparatuses to form a mixture of said chemicals and said feeding liquid; and f. dispensing said mixture into said process stream of said process through said adaptor of said apparatuses that is in communication with said process stream.

* * * * *